United States Patent [19]

Ohyama et al.

[11] Patent Number: 5,069,875

[45] Date of Patent: Dec. 3, 1991

[54] METHOD OF ADDING SILICON TO ALUMINUM

[75] Inventors: Koji Ohyama, Kawasaki; Masaki Tsunoda, Tokyo, both of Japan

[73] Assignee: Nikkin Flux Inc., Tokyo, Japan

[21] Appl. No.: 598,200

[22] Filed: Oct. 16, 1990

[30] Foreign Application Priority Data

Oct. 16, 1989 [JP] Japan ..... 1-268547

[51] Int. Cl.[5] ..... C22C 1/02

[52] U.S. Cl. ..... 420/548; 75/684; 75/685; 420/549

[58] Field of Search ..... 420/548, 549; 75/684, 75/685

[56] References Cited

U.S. PATENT DOCUMENTS 4,808,375 2/1989 Ivchenkov et al. ..... 420/548

*Primary Examiner*—R. Dean

*Assistant Examiner*—Robert R. Koehler

*Attorney, Agent, or Firm*—Fleit, Jacobson, Cohn, Price, Holman & Stern

[57] ABSTRACT

Disclosed is a method of adding silicon to aluminum. The method is characterized in that silicon particles having a diameter ranging between 2 mm and 50 mm are added to a molten aluminum together with a flux represented by the general formula XaMFb, where "X" represents an element included in the third or fourth period of the Periodic Table, "M" is a III or IV group element of the Periodic Table, and "F" is fluorine. A part of the flux may be added in the form of coating on the surface of the silicon particle.

4 Claims, 1 Drawing Sheet

METHOD OF ADDING SILICON TO ALUMINUM

BACKGROUND OF THE INVENTION

1. Field of the Invention

The present invention relates to a method of adding silicon to pure aluminum or an aluminum alloy.

2. Description of the Related Art

An aluminum-silicon alloy is widely used in various technical fields. In the initial stage of manufacture, the alloy was manufactured by the cast article manufacturers by adding required components to the pure aluminum. In the subsequent stage, the specialist alloy manufactures came to manufacture the aluminum-silicon alloy. However, marked improvements have been achieved recently in the melting equipment, and the analytical apparatus has come to be available at a low cost, with the result that the cast article manufacturers pay attentions again to the manufacture of the aluminum-silicon alloy.

The specific method of silicon addition widely accepted nowadays includes (A) elemental silicon addition, or (B) addition of aluminum-silicon mother alloy. In method A, however, the molten silicon has such a high temperature as 1414° C. Naturally, it is difficult to maintain the molten silicon at such a high temperature over a long time, leading to an rendered unsatisfactory in the case where the surfaces of the silicon particles are heavily oxidized or where the oxidation reaction of silicon is promoted under the state of a high temperature. What should also be noted is the necessity of removing impurities. To be more specific, the alkali metal or the like contained in the reducing agent, which is used in the manufacture of silicon, forms a slug of silicates, and the unreacted fluorite remains in the manufactured silicon. Further, a very hard compound of silicon carbide is left in the manufactured silicon. Naturally, it is necessary to remove these impurities.

Method (B), i.e., addition of aluminum-silicon mother alloy. invites an increased material cost. Specifically, the aluminum-silicon mother alloy contains only 20 to 25% by weight of silicon. Thus, it is necessary to add a large amount of the mother alloy, leading to an increased material cost noted above. Further, the increase in the addition amount of the aluminum-silicon mother alloy causes the melt temperature to be lowered, leading to an increase in the melting cost.

Various metals other than silicon are known to be added to aluminum for forming aluminum alloys. In many cases, the additive metals have a specific gravity higher than that of aluminum and, thus, can be added to molten aluminum relatively easily. For example, the specific gravity of manganese is 7.2, which is about three times as high as 2.7 for aluminum. On the other hand, the specific gravity of silicon is only 2.4. Naturally, manganese can be added to molten aluminum very easily, compared with the silicon addition. In addition, manganese a melting point of 1245° C. in contrast to 660.2° C. for aluminum. Further, silicon has a melting point of 1414° C., which is higher than . that of manganese. The high melting point of silicon is considered to make it difficult to add silicon to aluminum.

SUMMARY OF THE INVENTION

An object of the present invention is to provide a method of adding silicon to aluminum, which permits adding silicon to a molten aluminum at a low temperature so as to achieve the silicon addition with a high yield.

According to the present invention, there is provided a method of adding silicon to aluminum. characterized in that silicon particles having a diameter ranging between 2 mm and 50 mm are added to a molten aluminum together with a flux represented by the general formula XaMFb, where "X" represents an element included in the third or fourth period of the Periodic Table, "M" is a III or IV group element of the Periodic Table, and "F" is fluorine The present invention also provides a method of adding silicon to aluminum, characterized in that silicon particles having a diameter ranging between 2 mm and 50 mm and coated with a part of flux represented by the general formula XaMFb, where "X" represents an element included in the third or fourth period of the Periodic Table, "M" is a III or IV group element of the Periodic Table, and "F" is fluorine, and the residual of that flux are added to a molten aluminum.

In the present invention, it is possible to use singly at least one kind of the flux represented by the general formula noted above. It is also possible to use another flux in combination with the flux represented by the general formula noted above. The flux used in combination with the flux defined above includes, for example, NaF, NaCl, KCl, $AlF_3$, KF, $MgF_2$, $CaF_2$, $AlCl_3$, $CaCl_2$, $MgCl_2$, $C_2Cl_6$, $K_2CO_3$, $Na_2CO_3$, $CaCO_3$, $KNO_3$, $K_2SO_2$ and $Na_2SO_4$.

Where the silicon particle has a diameter smaller than 2 mm, the silicon particle has a very large specific surface area, with the result that the silicon particle is likely to be oxidized. In addition, the flux reacted in a molten state is absorbed on the silicon particle, resulting in failure to obtain a sufficient flux reaction. Further, small silicon particles, when added to a molten aluminum, floats on the melt. In this case, the oxidation reaction noted above proceeds selectively, resulting in a low silicon addition yield. On the other hand, it takes much time to melt the silicon particles and the silicon addition yield is low, if the silicon particles have a diameter larger than 50 mm.

Various other methods can be employed in the present invention. For example, it is also possible to add silicon particles coated with flux to a molten aluminum. Alternatively, it is possible to add the silicon particles coated with some portion of the flux to a molten aluminum together with the rest of the flux. It is also possible to disperse the flux on a molten aluminum, followed by adding the silicon particles when the flux has been melted. It is also possible to add both the silicon particles and the flux together to a molten aluminum. It is also possible to add a mixture of the silicon particles and the flux to a molten aluminum. Further, it is possible to stir the melt while adding the silicon particles and flux to a molten aluminum in accordance with above method.

To reiterate, the method of the present invention comprises the step of adding silicon particles having a diameter ranging between 2 mm and 50 mm to a molten aluminum together with the flux represented by the general formula noted above. The particular method of the present invention permits rapidly melting the added silicon particles in the aluminum melt so as to facilitate the silicon introduction into the molten aluminum. It follows that it is possible to prevent both aluminum and silicon from being oxidized, leading to an improved yield. What should also be noted is that the flux used in the present invention combine with the impurities contained in the silicon particles or the molten aluminum so as to facilitate removal of the impurities. In addition, the oxides are reduced by the reducing function of the flux.

Further, it is effective to add silicon particles coated with the flux to a molten aluminum together with flux particles. In this case, the flux coating serves to prevent the silicon particles from being oxidized. On the other hand, the flux particles directly added to the molten aluminum serves to prevent the melt from being oxidized, leading to an improved yield.

Additional objects and advantages of he invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWING

The accompanying drawing, which is incorporated in and constitutes a part of the specification, illustrates presently preferred embodiments of the invention and, together with the general description given above and the detailed description of the preferred embodiments given below, serves to explain the principles of the invention.

DETAILED DESCRIPTION OF THE PREFERRED EMBODIMENT

Figure 1:
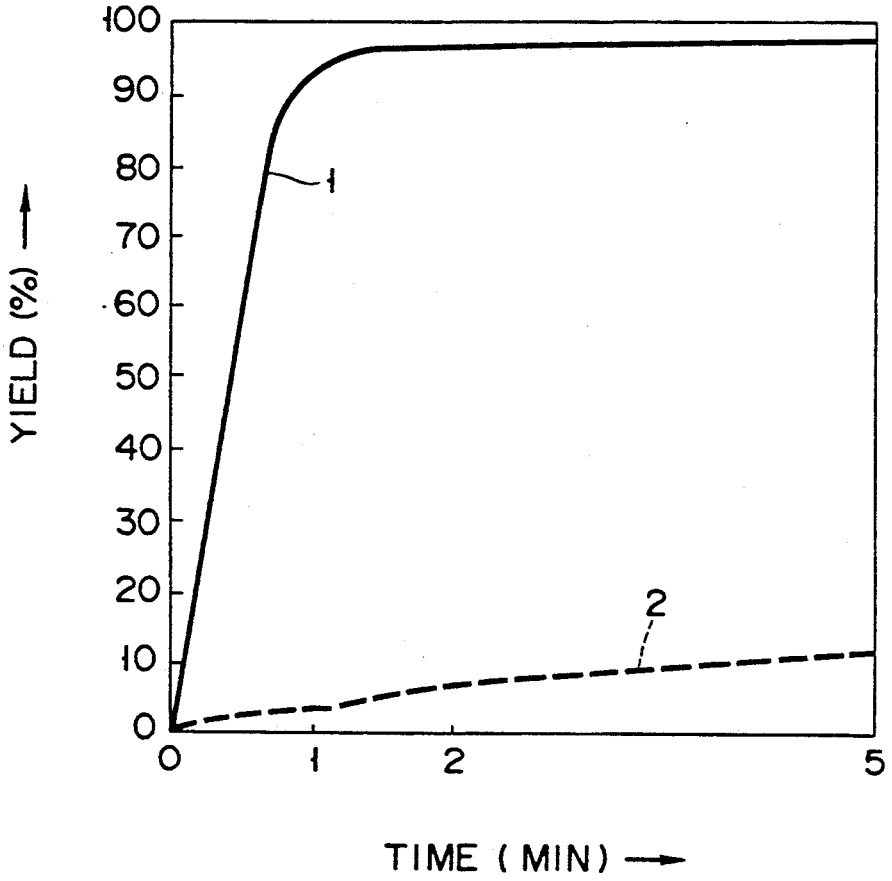
FIG. 1 is a graph showing the effect of the flux addition in the treatment of adding silicon to aluminum.

Examples 1 to 4 reported below were intended to clarify (2) the effect of flux addition, (2) details of the flux addition, (3) the preferred diameter of silicon particles, and (4) the method of silicon particle addition.

(1) The Effect of Flux Addition

EXAMPLE 1

93 kg of aluminum 1 having a purity of 99.85% was melted and maintained at 690° C., followed by adding 7 kg of silicon particles having a diameter of 2 to 15 mm and 8% by weight of a flux (30%NaCl+30%KCl+20%KAlF4+20%$K_2TiF_6$) based on the amount of the silicon particles to the surface of the aluminum melt. The silicon particles and the flux were spread on the melt surface and left to stand for one minute. Sampling was performed before the silicon addition. The melt surface was beaten ten times with a phosphorizer, followed by performing a first sampling. Then, after the melt was left to stand for one minute, the melt surface was beaten ten times with a phosphorizer, followed by performing a second sampling. Further, after the melt was left to stand for three minutes, the melt surface was beaten ten times and dross was removed, followed by performing a third sampling.

REFERENCE 1

Silicon particles were added to a molten aluminum as in Example 1, except that the flux was the melt.

Each of the sampled test pieces was subjected to photospectrometry, and the yield in each of Example 1 and Reference 1 was calculated as follows:

$$\text{Yield (\%)} = \frac{TP - TPO}{7(\%)} \times 100$$

where:

TP: Analytical value of silicon amount in each test piece; and

TPO: Analytical value of silicon amount in aluminum before the silicon addition

Each of Table 1 FIG. 1 shows the analytical results. Curves 1 and 2 shown in FIG. 1 represent Example 1 and Reference 1, respectively.

TABLE 1

| After Addition | Reference 1 Si article alone | Example 1 Si + Flux |
|---|---|---|
| 1 minute | 3.228% | 93.876% |
| 2 minutes | 6.528% | 97.112% |
| 5 minutes | 12.114% | 98.551% |

As apparent from Table 1, the flux addition permits improving the yield by more than 90% only one minute after the flux addition, compared with the addition of the silicon particles alone.

(2) Details of the Flux Addition

EXAMPLE 2 AND REFERENCE 2

Test pieces were prepared as in Example 1 by using 560 g of each of fluxes a) to n) given below:

| Fluxes Used | Period of Element X in the General Formular | Group of Element M in the General Formular |
|---|---|---|
| a) 100% $KAlF_4$ | 4 | III |
| b) 100% $K_2TiF_6$ | 4 | IV |
| c) 100% $K_2ZrF_6$ | 4 | IV |
| d) 30% NaCl + 20% KCl + 20% NaF + 30% $Na_3AlF_6$ | 3 | III |
| e) 30% NaCl + 20% KCl + 20% NaF + 30% $K_3AlF_6$ | 4 | III |
| f) 30% NaCl + 20% KCl + 20% NaF + 30% $KAlF_4$ | 4 | III |
| g) 30% NaCl + 20% KCl + 20% NaF + 30% $Na_2TiF_6$ | 3 | IV |
| h) 30% NaCl + 20% KCl + 20% NaF + 30% $Na_2ZrF$ | 3 | IV |
| i) 30% NaCl + 20% KCl + 20% NaF + 30% $K_2TiF_6$ | 4 | IV |
| j) 30% NaCl + 20% KCl + 20% NaF + 30% $K_2ZrF_6$ | 4 | IV |
| k) 40% NaCl + 30% KCl + 30% NaF | — | — |
| l) 30% NaCl + 20% KCl + 20% NaF + 30% $KPF_6$ | 4 | V |
| m) 30% NaCl + 20% KCl + 20% NaF + 30% $AgSbF_6$ | 5 | V |
| n) 30% NaCl + 20% KCl + 20% NaF + 30% $NH_4PF_6$ | — | V |

The yield (%) was measured for each of the test pieces. Table 2 shows the results.

TABLE 2

| Flux | 1 min. later | 2 min. later | 5 min. later |
|---|---|---|---|
| a | 83.56 | 87.62 | 92.57 |
| b | 93.19 | 97.85 | 99.03 |

TABLE 2-continued

| Flux | 1 min. later | 2 min. later | 5 min. later |
|---|---|---|---|
| c | 91.33 | 96.45 | 98.22 |
| d | 85.33 | 92.03 | 94.23 |
| e | 88.21 | 92.76 | 95.77 |
| f | 82.10 | 87.59 | 90.29 |
| g | 90.65 | 95.11 | 97.61 |
| h | 88.40 | 93.89 | 96.03 |
| i | 92.25 | 97.87 | 98.47 |
| j | 91.24 | 95.73 | 97.75 |
| k(Reference) | 0.94 | 1.51 | 7.18 |
| l(Reference) | 0.85 | 1.41 | 6.53 |
| m(Reference) | 1.12 | 2.03 | 8.01 |
| n(Reference) | 1.04 | 1.83 | 7.21 |

Table 2 clearly shows that fluxes a) to j) produced permanent effects. This indicates that the fluoride flux used in the present invention is effective for improving the yield. To be more specific, it is indicated that "X" in the general formula of the flux should be an element of the third or fourth period of the Periodic Table. It is also indicated that "M" in the general formula should be an element of Group III or IV of the Periodic Table. Table 2 further shows that the flux represented by the general formula defined in the present invention can be used singly, or a plurality of different fluxes can be used in combination, with satisfactory results.

(3) Particle Size of Silicon Particles

EXAMPLE 3

Test pieces were prepared as in Example 1 by using flux i) shown in Example 2. Silicon particles of different sizes were used in Example 3 as shown in Table 3. The yield (%) was measured for each of the test pieces which were sampled as in Example 1. Table 3 also shows the results.

TABLE 3

| Particle | Lapse of Time (minutes) | | | | | |
|---|---|---|---|---|---|---|
| Diameter (mm) | 1 | 2 | 5 | 10 | 20 | 30 |
| less than 2 | 20 | 25 | 25 | 25 | 25 | 25 |
| 2 to 15 | 92 | 98 | 98 | 98 | 98 | 98 |
| 15 to 50 | 73 | 80 | 87 | 90 | 95 | 98 |
| more than 50 | 5 | 8 | 15 | 30 | 40 | 50 |

Table 3 clearly shows that the particle size of the silicon particles added to a molten aluminum gives a prominent effect to the silicon addition yield to aluminum. It is seen that, where the silicon particle diameter is less than 2 mm, the silicon addition yield is as low as only 25% even 30 minutes after the silicon addition. It should be noted in this connection that the specific gravity of silicon is lower than that of aluminum. It follows that, if the silicon particle has a diameter smaller than 2 mm, the silicon particles float on the surface of the molten aluminum, resulting in failure to carry out chemical reactions. While the silicon particles are left floating on the melt surface, the metal silicon is considered to be oxidized, leading to a low silicon addition yield as shown in Table 3.

Table 3 also shows that the silicon addition yield is markedly improved if the silicon particles have a diameter ranging between 2 mm and 50 mm. The increased particle diameter represents a decrease in the specific surface area of the silicon particles. The oxidation of the metal silicon is suppressed with decrease in the specific surface area, with the result that the effect of the flux subjected to the melt reaction is increased so as to promptly introduce the silicon into the molten aluminum.

Further, where the silicon particles have a diameter larger than 50 mm, the silicon particles fail to be melted completely even at the time went smelt reaction of the flux is finished. In this case, the flux is quite incapable of producing its effect.

In conclusion, Table 3 clearly shows that the silicon particles added to a molten aluminum should have a diameter ranging between 2 mm and 50 mm.

(4) Method of Adding Silicon

EXAMPLE 4

Test pieces were prepared as in Example 1, except that the silicon particles used had a diameter of 2–15 mm and the silicon particles were added by methods (a) to (e) given below:

(a) Silicon particles having 3% by weight of flux based on the silicon amount coated on the surface and by weight of flux were simultaneously added to a molten aluminum.

(b) Silicon particles and 8% by weight of flux based on the silicon amount were simultaneously added to a molten aluminum.

(c) 8% by weight of flux based on the amount of silicon particles was dispersed on the surface of a molten aluminum. When the flux was melted, silicon particles were added to the molten aluminum.

(d) Silicon particles were left to stand on a molten aluminum, followed by dispersing 8% by weight of flux based on the silicon amount on the entire region of the silicon particles.

(e) Method (a) given above was performed while stirring the molten aluminum with a stirring device.

Table 4 shows the results.

TABLE 4

| Adding Method | Time to reach 98% yield | Dross amount |
|---|---|---|
| (a) | 3 minutes | small |
| (b) | 5 minutes | somewhat large |
| (c) | 3 minutes | somewhat large |
| (d) | 8 minutes | somewhat large |
| (e) | 1½ minutes | small |

Table 4 shows that method (a) is desirable for adding silicon particles and a flux to a molten aluminum. It is seen that method (e), in which the entire molten aluminum is kept stirred, permits shortening the mixing time. In other words, it has been clarified that the stirring state of the entire molten aluminum is most desirable in terms of the condition on the side of the aluminum.

As described above in detail, the method of the present invention makes it possible to add silicon with a high yield to a molten aluminum at about the melting point of aluminum, with the result that it is unnecessary to use a high temperature equipment. In other words, the preset invention is prominently effective in terms of the silicon addition cost, too.

Additional advantages and modifications will readily occur to those skilled in he art. Therefore, the invention in its broader aspects is not limited to the specific details, and illustrated examples shown and described herein. Accordingly, various modifications may be without departing from the spirit or scope of the general inventive concept as defined by the appended claims and their equivalents.

What is claimed is:

1. A method of adding silicon to aluminum, wherein silicon particles having a diameter ranging between 2 mm and 50 mm are added to a molten aluminum together with a flux represented by the general formula XaMFb, where "X" represents an element included in the third or fourth period of the Periodic Table, "M" is a III or IV group element of the Periodic Table, and "F" is fluorine.

2. A method of adding silicon to aluminum, wherein silicon particles having a diameter ranging between 2 mm and 50 mm and coated with a part of flux represented by the general formula XaMFb, where "X" represents an element included in the third or fourth period of the Periodic Table, "M" is a III or IV group element of the Periodic Table, and "F" is fluorine, and the residual of that flux are added to a molten aluminum.

3. A method of adding silicon to aluminum according to claim 1 wherein said X is at least one element selected from the group consisting K, Na and Ca.

4. A method of adding silicon to aluminum according to claim 1 or 2, wherein said M is at least one element selected from the group consisting Ti, Zr, Al, B and Si.

* * * * *